United States Patent [19]

Eberhardt

[11] 4,018,544

[45] Apr. 19, 1977

[54] CENTRIFUGAL PUMP

[75] Inventor: H. Alfred Eberhardt, Paoli, Pa.

[73] Assignee: Hale Fire Pump Company, Conshohocken, Pa.

[22] Filed: Feb. 20, 1976

[21] Appl. No.: 659,742

[52] U.S. Cl. ..... 415/170 A; 415/122 R; 277/137

[51] Int. Cl.[2] ..... F04D 29/16

[58] Field of Search ..... 415/170 A; 277/137, 277/100, 99

[56] References Cited

UNITED STATES PATENTS

| | | | |
|---|---|---|---|
| 1,369,379 | 2/1921 | Bogdanoff | 415/170 A |
| 1,369,508 | 2/1921 | Weiner et al. | 415/170 A |
| 1,783,427 | 12/1930 | Jennings | 415/170 A |
| 3,020,053 | 2/1962 | Millar et al. | 277/137 |
| 3,066,612 | 12/1962 | Haentjens | 415/170 A |
| 3,779,667 | 12/1973 | Johnson | 415/170 A |

*Primary Examiner*—Henry F. Raduazo
*Attorney, Agent, or Firm*—Frederick J. Olsson

[57] ABSTRACT

Centrifugal pump including: (a) impeller drive with parallel low speed input and high speed output shafts having integral drive and pinion gears: (b) a combination housing-pumphead configured to maintain concentricity in critical areas and adapt the pump for either a gas engine or an electric motor drive; and (c) a clearance ring assembly which will allow clearance ring and impeller to shift radially to natural positions.

1 Claim, 6 Drawing Figures

CENTRIFUGAL PUMP

This invention relates to improvements in centrifugal pumps particularly the type having an impeller rotating in a fluid chamber to cause fluid to flow from a suction section through the impeller and out of a discharge section.

One object of the invention is to provide in an impeller type centrifugal pump, a clearance ring assembly which achieves minimal leakage between discharge and suction sections and thereby makes such pumps more efficient for high pressure/low volume applications.

Another object of the invention is to provide in a pump of the kind in question, a clearance ring assembly which will maintain its sealing function while accommodating misalignment and/or radial shift of the impeller and its shaft.

Another object of the invention is to provide in a pump of the kind in question, a clearance ring assembly which allows locating surfaces employed for supporting and locating the high speed impeller shaft to be machined with nominal tolerances and thereby save in manufacturing costs.

Another object is to provide a housing for a pump of the kind in question wherein locating surfaces employed in supporting and locating a high speed impeller shaft together with a pilot means for the impeller casing are all machined in a single setup.

Another object of the invention is to provide in a pump the kind in question an impeller drive which permits substantial reduction in the over-all size of the pump.

Another object of the invention is to provide in a pump of the kind in question, a housing structure and impeller drive which permits, upon change of a minimal number of parts, for the pump to be driven by a gas engine or an electric motor.

A typical fluid pump of the invention will be described below in connection with the following drawings wherein.

Figure 2:
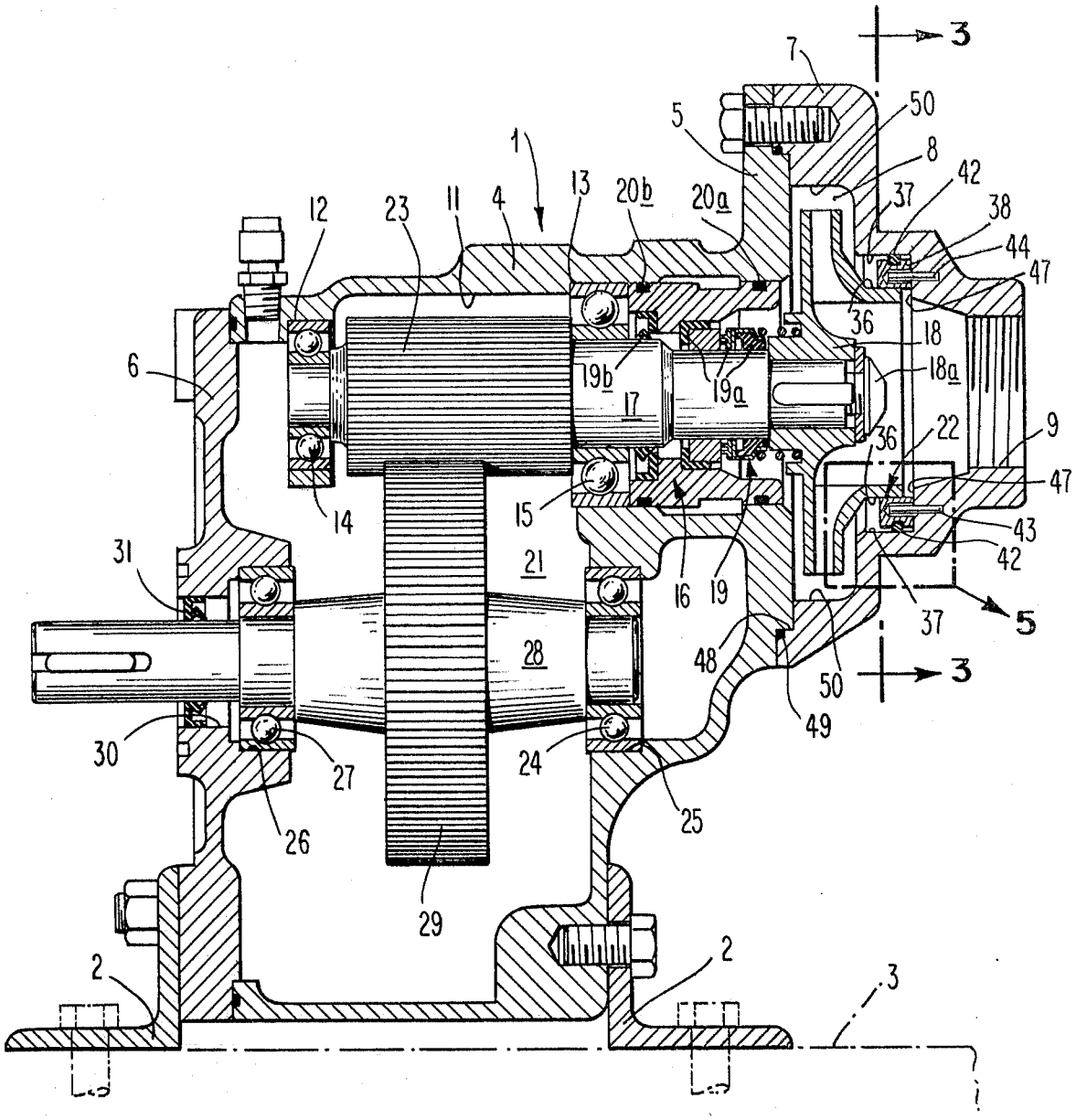
FIG. 2 is an enlarged cross sectional view taken along the lines 2—2 of FIG. 1.

Referring to FIG. 2 the the pump has a housing assembly 1 mounted on brackets 2 supported by the platform 3. The housing assembly 1 comprises the hollow main casting 4 including the radially extending end plate 5, removable cover 6 and the hollow impeller casing 7 connected to the end plate. The impeller casing 7 and the end plate 5 form fluid chamber 8 having suction section 9 and discharge section 10. The casing 4 has apertured ears (not shown) by means of which the cover 6 is bolted in place.

The main casting 4 has an elongated bore 11 the open end of which terminates at the end plate 5. The bore is formed with machined sockets 12 and 13 which respectively carry the bearings 14 and 15 and the seal housing 16. A high speed output shaft 17 disposed within bore 11 is rotatably supported by bearings 14 and 15. The shaft 17 extends thru the seal housing 16 outwardly of the open end of the bore into the chamber 8 where a centrifugal impeller 18 is fixedly connected thereto by a key and nut assembly 18*a*.

The impeller 18 is disposed within the chamber 8 between the suction 8 and discharge section 10. With rotation of the impeller fluid is caused to flow from the suction section 9 through the impeller and then outwardly into the discharge section 10 where it exits from the pump. The impeller structure for accomplishing this flow is conventional.

The seal housing 16 is locked by set screws not shown and is butted against the bearing 15 to hold the same in socket 13. A shoulder on shaft 17 holds bearing 14 in socket 12. Within the seal housing 16 is a mechanical seal assembly 19 of conventional design which is spring biased between the impeller and seal housing and provides rotary fluid seal means 19*a* for the output shaft 18. Also within the housing 16 is oil seal means 19*b*. Around the exterior of the housing 16 are the "O" ring type seals 20*a* and 20*b* which cooperate with the socket 13.

The seals function to divide the housing assembly two chambers, the first being the above mentioned fluid chamber 8 and the second being a drive chamber indicated at 21. The chamber 21 contains certain gearing and so may be partially filled with lubricating oil.

The seals 19*a* and 20*a* seal the fluid in chamber 8 and the seals 19*b* and 20*b* seal the oil in the chamber 21.

A clearance ring assembly 22 in the fluid chamber 8 separates the suction section 9 from the discharge section 10. The function of the ring is to allow the impeller to rotate while at the same time preventing or miminizing the flow of fluid from the high pressure discharge section 10 back into the low pressure suction section 9. Clearance rings per se are conventional in impeller type centrifugal pumps. However, the clearance ring assembly shown herein has several unique features as will be described later.

The output shaft 17 carries pinion 23 formed integrally with the shaft having been machined from the shaft blank.

The main casting 4 carries a bearing 24 mounted in socket 25. The cover 6 carries bearing 26 mounted in socket 27. These bearings rotatably support a low speed input shaft 28. The input shaft carries a drive gear 29 formed integrally with the shaft having been machined from the shaft-gear blank or casting.

As noted in FIG. 2 the input shaft 28 extends outwardly of the housing thru an aperture 30 in the cover. In the embodiment of FIG. 2, the shaft 28 is adapted to be connected to an electric motor (not shown) which is mounted on the platform 3.

The drive chamber 21 may be filled with lubricating oil for the gears and in such cases an oil seal 31 is provided in the aperture 30.

The shafts 17 and 28 are supported by the respective bearings so as to extend parallel to one another and to be relatively closely spaced. The advantages of this will be pointed out below.

Figure 6:
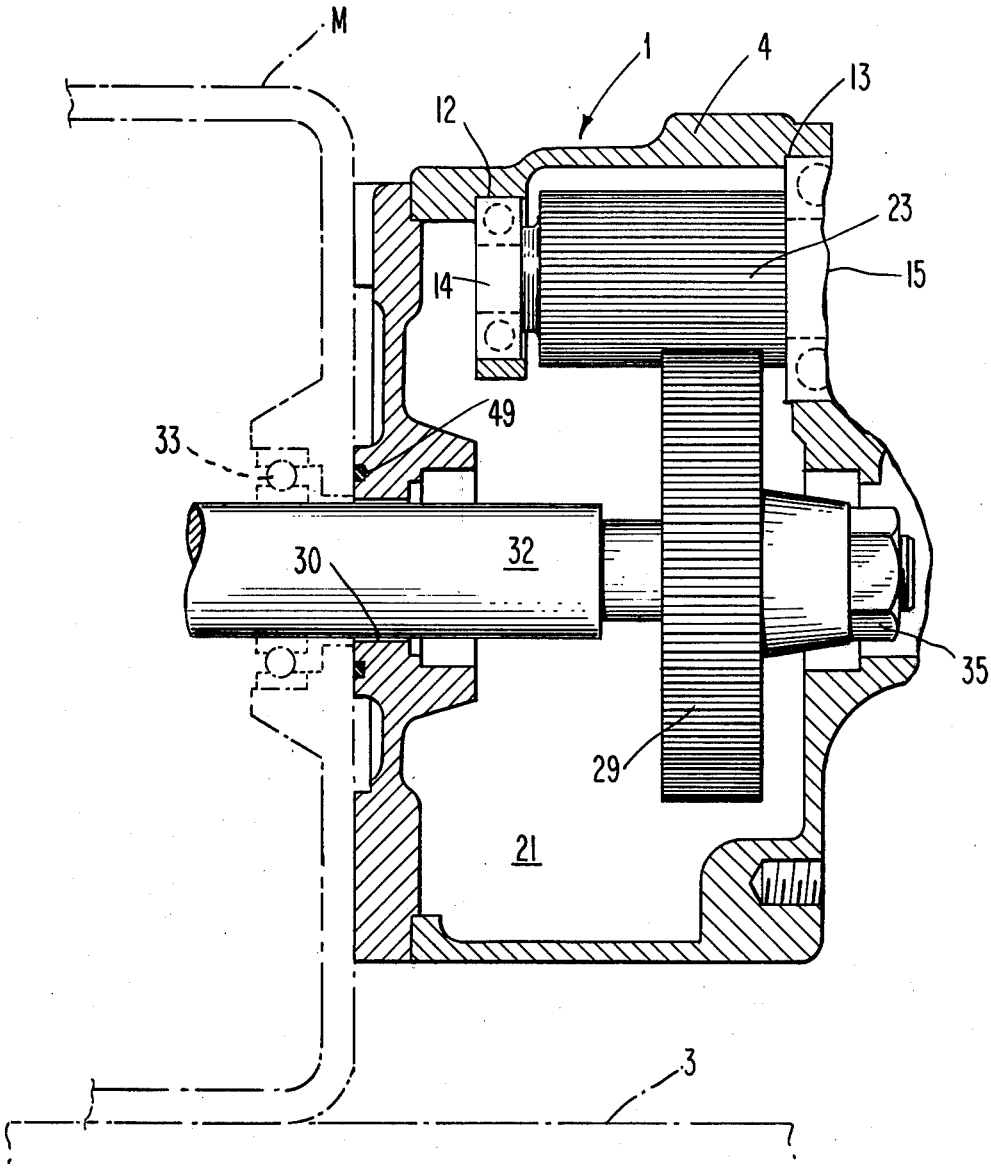
FIG. 6 is an elevational view showing one way in which the pump may be adapted for a gas engine as the prime mover.

One arrangement of the pump wherein a gasoline engine is the prime mover is shown in FIG. 6. As noted in that Figure, the bearings 24 and 26, the shaft 28 and seal 31 are not employed.

A motor housing generally indicated by the dotted lines M is bolted to cover 6 by bolts not shown. The motor housing supports the pump housing so the brackets 2 are not used. The motor shaft 32 extends through the aperture 30 into the drive chamber 21. The shaft 32 is supported in the motor housing by bearings one of which is indicated at 33. A drive gear 34 is fixed to the shaft 33 by the key-nut assembly 35.

An alternative arrangement wherein the pump housing is supported by the motor housing contemplates that the cover 6 be removed the wall of the motor housing substituted. The motor housing and casting 4 are bolted together similarly as cover 6 and casting 4.

The arrangement which provides for the pump to have a gas engine or electric motor as prime mover is extremely simple requiring a minimum number of different parts and minimum assembly time with consequent savings in material and labor costs.

The use of relatively closely spaced and parallel input and output shafts is highly advantageous. The pinion gear 23 being integral with the shaft 17 results in a smaller diameter pinion gear and consequently less radial space is needed for both gears. This allows greater compactness in the overall size of the pump and hence smaller, less expensive parts.

Figure 5:
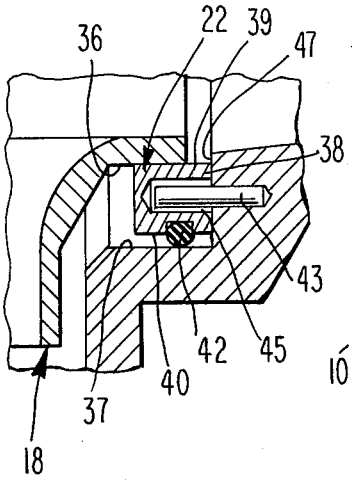
FIG. 5 is an enlarged fragmentary view taken in section 5 of FIG. 2.
Figure 1:
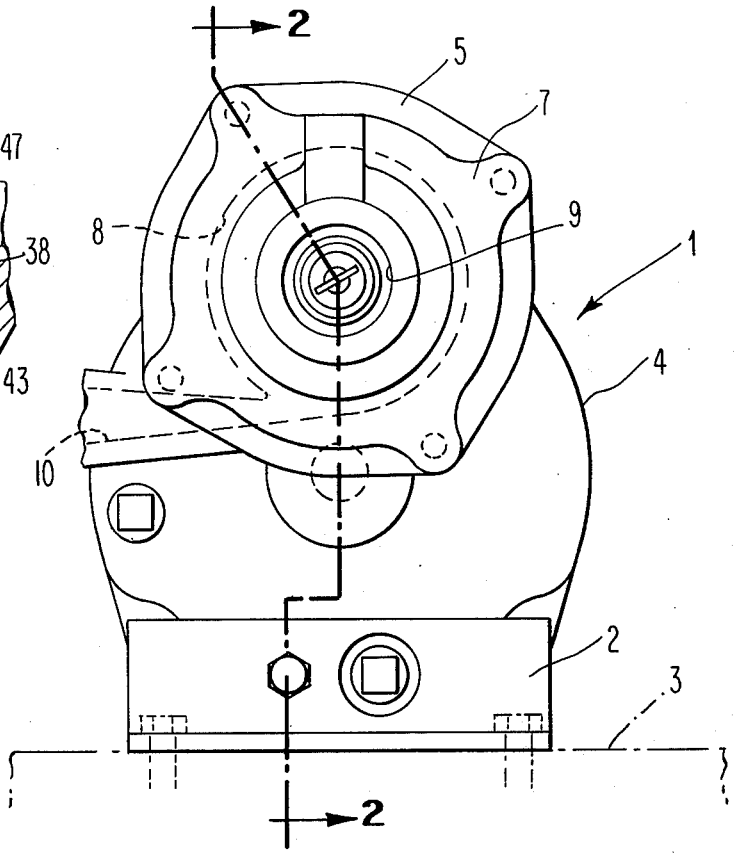
FIG. 1 is an elevational view of a pump which is constructed in accordance with the invention and adapted for an electric motor as the prime mover.
Figure 3:
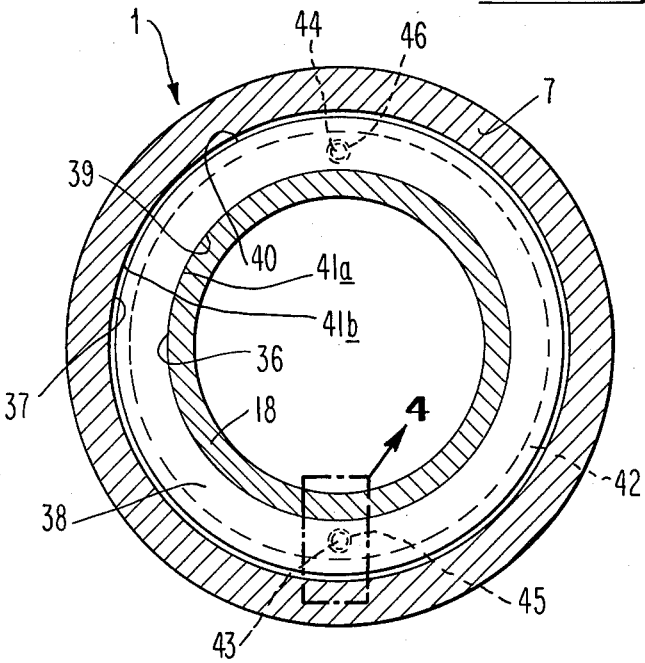
FIG. 3 is an enlarged elevational view taken along 3—3 of FIG. 2.
Figure 4:
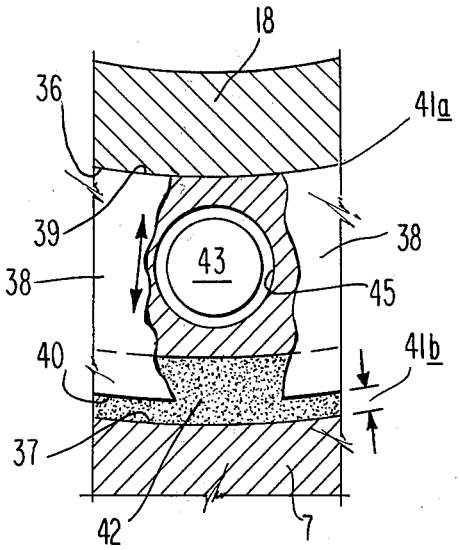
FIG. 4 is an enlarged fragmentary view taken in section 4 of FIG. 3.

The clearance ring assembly 22 will be noted below particularly in connection with FIGS. 3, 4 and 5.

The impeller 18 has an exterior annular or cylindrical surface 36 which is concentric with the impeller rotational axis.

The impeller casing 7 has an annular or cylindrical interior surface 37 which extends around and is concentric with the impeller surface 36.

Between the surfaces 36 and 37 is a rectangular shaped clearance ring 38. The ring has an interior annular or cylindrical surface 39 and outside surface 40. The clearance **41*a* between the annular surface 36 of the impeller and the clearance ring surface 39** is held to approximately three mils.

The clearance **41*a* provides that the impeller can rotate relative to the ring, for the ring to move axially on the impeller and for the impeller, if it shifts radially, to immediately contact and shift the ring. The small clearance also serves as a seal by minimizing the tendency of fluid to flow from the high pressure discharge section 10 into the low pressure suction section 9.**

Between the outside surface 40 of the clearance ring and the impeller casing surface 37 is a substantial space **41*b* which preferably is in the order of 20 mils. The large space 41*b* permits axial and radial movement of the ring. To avoid leakage thru this space an annular "O" ring seal 42** is employed.

A pair of pins 43 and 44 are fixed to the impeller casing 7 respectively extend to apertures 45 and 46 formed in the ring. The diameter of each pin is considerably smaller than the diameter of its aperture so that there is substantial clearance (note FIG. 4). The clearance permits axially and radial motion of the ring but prevents rotation.

The clearance ring assembly structure described is ideally suited for the high pressure-low volume pumps particularly because the three mil clearance between the ring and the impeller holds leakage to a minimum and imposes negligible drag. The ability of the ring to shift allows the impeller to move radially so as to seek its natural rotational position. The ring, by moving with the impeller, will also find the natural place to perform its intended function in the most efficient manner.

With respect to motion of the ring, it is pointed out that the high pressure of the fluid in the fluid chamber acts on the side of the ring and drives the same up against the surface 47 on casing 7. This surface intersects and is normal to the surface 37. The space **41*b*** may eventually fill with dirt or corrosion. This takes place long after the impeller and ring have found their natural positions. The dirt or corrosion may harden and so lock the ring and impeller in position. The latter, of course, is desirable.

The impeller casing 7 is supported and located on the end plate 5 by the pilot 48. An "O" ring 49 in the pilot seals off the chamber 8. Proper locating of the casing 7 is important because the interior annual surface 50 must be substantially concentric with impeller axis.

Manufacturing errors in the bearings 14 and 15 and/or in the impeller shaft 17 may cause deviation of the axis of the shaft (hence the impeller) from the ideal or desired position. Play or wear in the bearings, particularly if not uniform between bearings, will cause deviation of the impeller from its desired axis. The ability of the clearance ring to shift automatically accommodates such deviation and permits the output shaft and impeller to find natural running positions. There are many self-evident advantages of this, for example, stress elimination and unnatural wear and the like.

Another very important advantage of the shifting feature is that it will permit the locating and supporting surfaces of the sockets 14 and 15 and the pilot 48 to be machined with only nominal tolerance since deviation will be compensated for by the shift of the ring. This is very effective in substantially reducing machining costs.

Additionally, the described structure provides that the pilot 48 and the sockets 12 and 13 can all be machined in a single set-up and then the casting simply turned over and the socket 25 machined. Therefore, set-up, machining and handling time are reduced with the significant cost savings.

I claim:

1. In a fluid pump;

a housing formed with a fluid chamber including a fluid suction section and a fluid discharge section;

an impeller mounted for rotation in said chamber to cause fluid to flow from the suction section to the discharge section, the impeller having an exterior cylindrically shaped working surface concentric with its axis of rotation and being disposed adjacent the suction section;

an interior cylindrically shaped surface formed on said housing adjacent the suction section and substantially concentric with said cylindrical surface on the impeller;

an annular radially extending abutment surface formed on said housing and co-axial with said cylindrical surface on the housing;

a clearance ring disposed between said cylindrical surfaces and separating said suction and discharge sections, the clearance ring having a cylindrically shaped outer surface and a cylindrically shaped inner surface;

means connected between the housing and the ring permitting axial and radial motion of the ring and maintaining the ring in a non-rotary condition while the impeller rotates;

the diameter of the inner surface of the ring being greater than the diameter of the impeller cylindrical surface to form minimal clearance therebetween, the clearance permitting the impeller to rotate and causing the impeller cylindrical surface to immediately contact the inside surface of the ring in the event the impeller is misaligned and/or shifts radially and thereby cause the ring to shift radially while minimizing fluid leakage from the discharge section thru the clearance to the suction section;

the diameter of the outer surface of the ring being substantially less than the diameter of the housing cylindrical surface to provide space for the ring to move radially if caused to do so by the impeller and also for the ring to move axially, the fluid pressure of the discharge section causing the ring to move axially whereby the ring engages said radially extending abutment surface; and seal means between the ring and the housing to prevent fluid leakage from the discharge section thru said space to the suction section.

* * * * *